US012169082B2

(12) United States Patent
Washiyama et al.

(10) Patent No.: US 12,169,082 B2
(45) Date of Patent: Dec. 17, 2024

(54) AIR-CONDITIONING APPARATUS

(71) Applicant: Mitsubishi Electric Corporation, Tokyo (JP)

(72) Inventors: Hiroki Washiyama, Tokyo (JP); Yuji Motomura, Tokyo (JP); Koji Furuya, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 244 days.

(21) Appl. No.: 18/000,308

(22) PCT Filed: Aug. 3, 2020

(86) PCT No.: PCT/JP2020/029685
§ 371 (c)(1),
(2) Date: Nov. 30, 2022

(87) PCT Pub. No.: WO2022/029845
PCT Pub. Date: Feb. 10, 2022

(65) Prior Publication Data

US 2023/0194131 A1 Jun. 22, 2023

(51) Int. Cl.
*F25B 1/00* (2006.01)
*F25B 13/00* (2006.01)
(Continued)

(52) U.S. Cl.
CPC ..... *F25B 13/00* (2013.01); *F25B 41/31* (2021.01); *F25B 49/00* (2013.01); *F25B 2313/02741* (2013.01); *F25B 2700/19* (2013.01)

(58) Field of Classification Search
CPC ..... F25B 13/00; F25B 41/31; F25B 49/00; F25B 2313/02731; F25B 2313/02732;
(Continued)

(56) References Cited

U.S. PATENT DOCUMENTS 9,791,180 B2 * 10/2017 Shimamoto ..... F24F 3/065
2012/0234032 A1 * 9/2012 Yamashita ..... F25B 13/00 62/160
(Continued)

FOREIGN PATENT DOCUMENTS

JP 5911561 B2 4/2016

OTHER PUBLICATIONS

International Search Report of the International Searching Authority mailed Sep. 24, 2020 for the corresponding international application No. PCT/JP2020/029685 (and English translation).

*Primary Examiner* — Marc E Norman
(74) *Attorney, Agent, or Firm* — Posz Law Group, PLC

(57) ABSTRACT

An air-conditioning apparatus includes a low-pressure-side pressure sensor that detects the pressure of heat-source-side refrigerant that flows into a compressor and outputs it as a first detection value and a high-pressure-side pressure sensor that detects the pressure of heat-source-side refrigerant discharged from the compressor and outputs it as a second detection value. When switching the operation mode of the apparatus, a controller determines whether the ratio of the first detection value to the second detection value is higher than a first threshold. When the ratio is higher than the threshold, the controller causes a second refrigerant flow switching device to perform a switching operation. When the ratio is less than or equal to the threshold, the controller makes an adjustment such that an opening degree of an expansion device is less than a second threshold, and then causes the second refrigerant flow switching device to perform the switching operation.

7 Claims, 9 Drawing Sheets

(51) Int. Cl.
*F25B 41/31* (2021.01)
*F25B 49/00* (2006.01)

(58) Field of Classification Search
CPC ..... F25B 2313/02741; F25B 2313/006; F25B 2313/0231; F25B 2313/0292; F25B 2700/19; F25B 2700/1931; F25B 2700/1933
See application file for complete search history.

(56) References Cited

U.S. PATENT DOCUMENTS

| | | | | |
|---|---|---|---|---|
| 2014/0083123 | A1* | 3/2014 | Yamashita | F25B 49/02 62/222 |
| 2014/0260405 | A1* | 9/2014 | Yamashita | F25B 13/00 62/335 |
| 2014/0305152 | A1* | 10/2014 | Morimoto | F25B 49/02 62/126 |
| 2014/0318163 | A1* | 10/2014 | Takayama | F25B 25/005 62/196.1 |
| 2015/0000325 | A1 | 1/2015 | Honda et al. | |
| 2015/0247661 | A1* | 9/2015 | Ishimura | F25B 41/34 62/324.6 |
| 2015/0300714 | A1* | 10/2015 | Ishimura | F25B 49/02 62/228.1 |
| 2015/0330674 | A1* | 11/2015 | Yamashita | F25B 13/00 62/160 |
| 2023/0250992 | A1* | 8/2023 | Furuya | F25B 49/02 |

* cited by examiner

<COOLING MAIN OPERATION MODE>

<HEATING MAIN OPERATION MODE>

AIR-CONDITIONING APPARATUS

CROSS REFERENCE TO RELATED APPLICATION

This application is a U.S. national stage application of International Patent Application No. PCT/JP2020/029685 filed on Aug. 3, 2020, the disclosure of which is incorporated herein by reference.

TECHNICAL FIELD

The present disclosure relates to an air-conditioning apparatus, and in particular, to an air-conditioning apparatus that reduces pipe vibration that would occur at the time of switching an operation mode.

BACKGROUND

In the past, air-conditioning apparatuses in each of which a relay unit is installed between an outdoor unit and an indoor unit have been proposed (see, for example, Patent Literature 1).

Such a kind of air-conditioning apparatus includes a refrigerant cycle circuit that causes heat-source-side refrigerant to circulate through a refrigerant pipe located between the outdoor unit and the relay unit and a heat-medium cycle circuit that causes a heat medium to circulate through a refrigerant pipe located between the relay unit and the indoor unit.

In the air-conditioning apparatus, in part of the refrigerant cycle circuit that is located in the relay unit, a four-way valve, an expansion valve, and a solenoid valve are provided. The four-way valve switches a flow passage between a flow passage through which high-pressure refrigerant flows and a flow passage through which low-pressure refrigerant flows. The expansion valve controls the flow rate of refrigerant. The solenoid valve blocks the flow of refrigerant.

PATENT LITERATURE

Patent Literature 1: Japanese Patent No. 5911561

In such air-conditioning apparatus as described above, in a refrigerant passage, when an operation mode is switched from a heating operation mode to a cooling operation mode, high-pressure refrigerant stays in part of the refrigerant cycle circuit that is located between the four-way valve and the expansion valve in the relay unit. Thus, when the four-way valve and the expansion vale in the relay unit switch their flow passages at the same time, the high-pressure refrigerant that stays in the above part abruptly flows in a low-pressure pipe. As a result, an impact of the abrupt inflow of the high-pressure refrigerant causes vibrations of the refrigerant pipe in the relay unit.

SUMMARY

The present disclosure is applied to solve the above problem, and relates to an air-conditioning apparatus capable of reducing occurrence of vibrations of a refrigerant pipe that would be caused by switching of an operation mode.

An air-conditioning apparatus according to an embodiment of the present disclosure includes: a refrigerant cycle circuit in which a compressor, a first refrigerant flow switching device, a heat-source-side heat exchanger, a plurality of expansion devices, a plurality of heat-medium heat exchangers, and a plurality of second refrigerant flow switching devices are connected by a refrigerant pipe, the refrigerant cycle circuit being configured to cause heat-source-side refrigerant to circulate through the refrigerant pipe; and a heat-medium cycle circuit in which the heat-medium heat exchangers, a pump, and a plurality of load-side heat exchangers are connected by a heat medium pipe, the heat-medium cycle circuit being configured to cause a heat medium to circulate through the heat medium pipe. Each of the heat-medium heat exchangers is configured to cause heat exchange to be performed between the heat-source-side refrigerant and the heat medium. The air-conditioning apparatus further includes: a low-pressure-side pressure sensor configured to detect a pressure of the heat-source-side refrigerant that flows into the compressor and output the pressure as a first detection value; a high-pressure-side pressure sensor configured to detect a pressure of the heat-source-side refrigerant discharged from the compressor and output the pressure as a second detection value; and a controller configured to control opening degrees of the expansion devices. The air-conditioning apparatus has a heating operation mode and a cooling operation mode as operation modes. The first refrigerant flow switching device is configured to switch a flow of the heat-source-side refrigerant between the flow of the heat-source-side refrigerant in the heating operation mode and the flow of the heat-source-side refrigerant in the cooling operation mode. Each of the second refrigerant flow switching devices is configured to switch the flow of the heat-source-side refrigerant, according to switching of the operation mode of the air-conditioning apparatus, such that an associated one of the heat-medium heat exchangers operates as a condenser or an evaporator. Each of the expansion devices is provided in association with an associated one of the heat-medium heat exchangers and located upstream of the associated heat-medium heat exchanger in a flow direction of the heat-source-side refrigerant when the associated heat-medium heat exchanger operates as an evaporator. Each of the second refrigerant flow switching devices is provided in association with an associated one of the heat-medium heat exchangers and located downstream of the associated heat-medium heat exchanger in the flow direction of the heat-source-side refrigerant when the heat-medium heat exchanger operates as an evaporator. The controller is configured to determine, when switching the operation mode of the air-conditioning apparatus, whether a ratio of the first detection value to the second detection value is higher than a first threshold or not. The controller is configured to perform, when the ratio is higher than the first threshold, control to cause one of the second refrigerant flow switching devices to perform a switching operation, the one of the second refrigerant flow switching devices being required to perform the switching operation, according to switching of the operation mode of the air-conditioning apparatus. The controller is configured to adjust, when the ratio is less than or equal to the first threshold, an opening degree of one of the expansion devices that is connected to the second refrigerant flow switching device required to perform the switching operation, such that the opening degree of the one of the expansion devices is less than a second threshold, and perform control to cause the second refrigerant flow switching device to perform the switching operation.

In an air-conditioning apparatus according to an embodiment of the present disclosure, it is possible to reduce occurrence of vibrations of a refrigerant pipe that would be caused by switching of an operation mode.

DETAILED DESCRIPTION

An air-conditioning apparatus according to an embodiment of the present disclosure will be described with reference to the drawings. The description regarding the following embodiment is not limiting, and various modifications can be made without departing from the gist of the present disclosure. Furthermore, the present disclosure encompasses all combinations of combinable ones of the configurations of components in the following embodiment and a modification thereof. In each of figures, components that are the same as or equivalent to those in a previous figure or previous figures are denoted by the same reference signs, and the same is true of the entire text of the specification. In the figures, relative relationships in dimension between components or the shapes of the components, or other features of the components may be different from actual ones.

Embodiment 1

Figure 1:
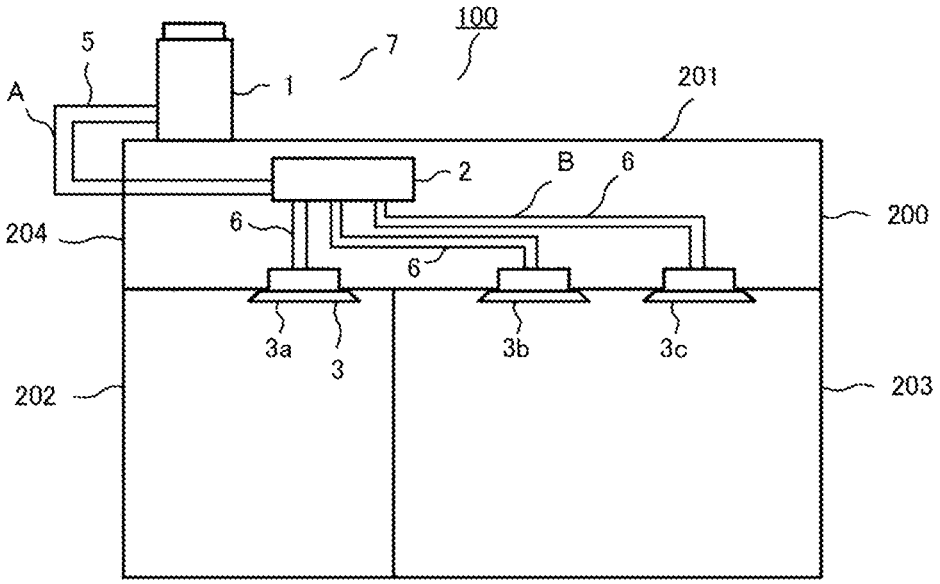
FIG. 1 is a schematic view illustrating an example of installation of an air-conditioning apparatus 100 according to Embodiment 1.

FIG. 1 is a schematic view illustrating an example of installation of an air-conditioning apparatus 100 according to Embodiment 1. The air-conditioning apparatus 100 according to Embodiment 1 has a cooling operation mode and a heating operation mode as operation modes. The cooling operation mode includes a cooling only operation mode and a cooling main operation mode. The heating operation mode includes a heating only operation mode and a heating main operation mode. These operation modes will be described later with reference to FIGS. 3 to 6.

As illustrated in FIG. 1, the air-conditioning apparatus 100 is installed in a building 200. The air-conditioning apparatus 100 includes an outdoor unit 1, one or more indoor units 3, and a relay unit 2.

As illustrated in FIG. 1, the outdoor unit 1 is a heat source unit and provided in an outdoor space 7 located outside the building 200. The outdoor unit 1 is installed, for example, on the rooftop of the building 200.

The indoor units 3 are installed in the building 200. Although in the example illustrated in FIG. 1, three indoor units 3 are provided, the number of indoor units 3 is not limited to specific numbers but may be any number larger than or equal to 1. Furthermore, in the case where the indoor units 3 are distinguished from each other, they will be referred to as "indoor unit 3*a*", "indoor unit 3*b*", and "indoor unit 3*c*".

In the following description, a plurality of components that are of the same kind will be denoted by reference signs including suffixes a, b, c, . . . , in the case where they are distinguished from each other.

The indoor units 3*a*, 3*b*, and 3*c* are installed in one or more indoor spaces 202 and 203 provided in the building 200. The indoor units 3*a*, 3*b*, and 3*c* supply cooling air or heating air to the indoor spaces 202 and 203. The indoor spaces 202 and 203 are air-conditioning target spaces. In the example illustrated in FIG. 1, the indoor unit 3*a* is installed in the indoor space 202 and performs cooling and heating of the indoor space 202. The indoor units 3*b* and 3*b* are installed in the indoor space 203 and perform cooling and heating of the indoor space 203. In such a manner, one of the indoor units 3*a*, 3*b*, and 3*c* may be installed in one indoor space, or two or more of the indoor units 3*a*, 3*b*, and 3*c* may be installed in one indoor space.

Figure 2:
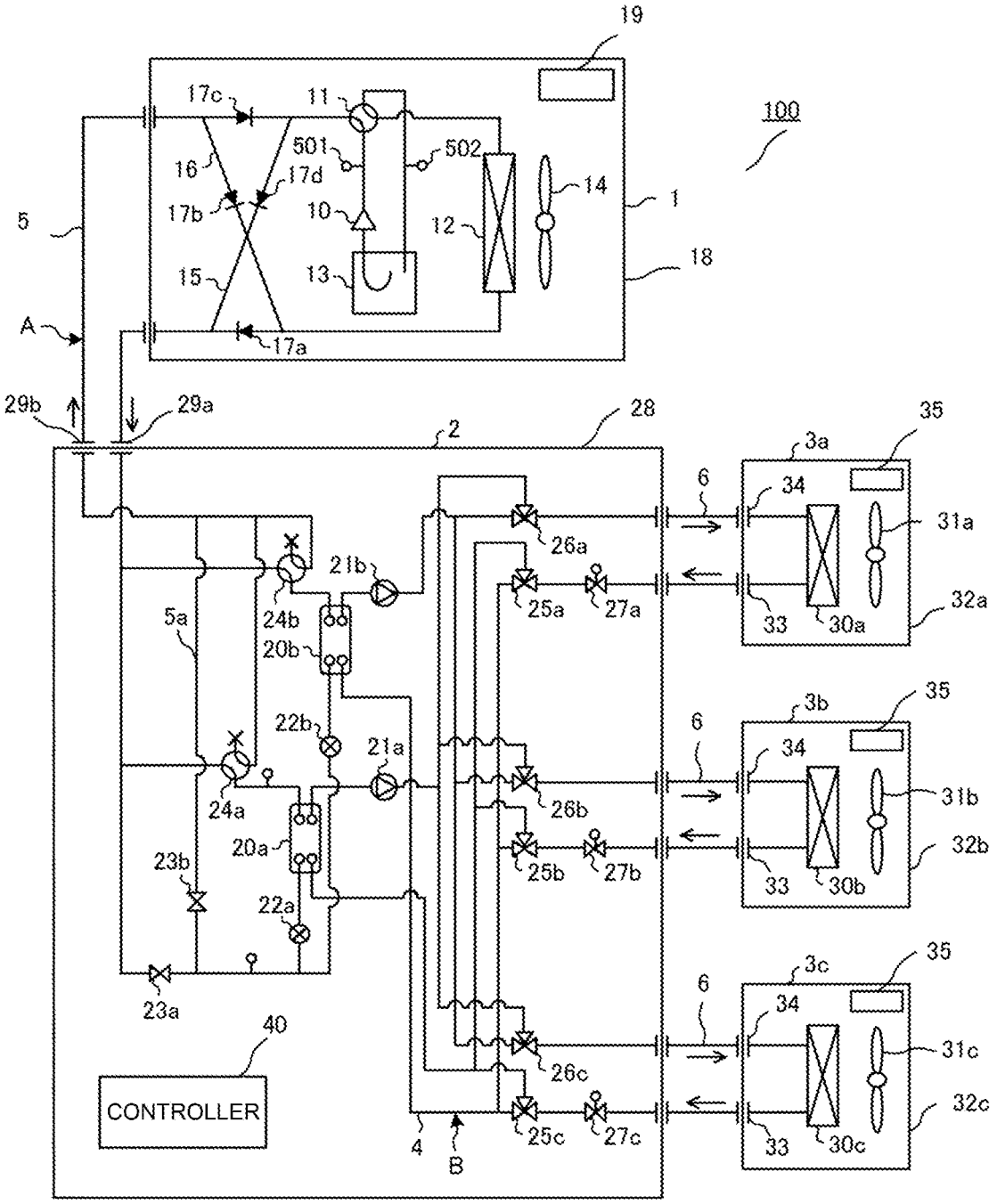
FIG. 2 illustrates an example of the configuration of the air-conditioning apparatus 100 according to Embodiment 1.

The relay unit 2 is installed between the outdoor unit 1 and the indoor units 3. The relay unit 2 is installed in a space 204 in the building 200. The space 204 is a space separate from the indoor spaces 202 and 203, and is, for example, a shared space or a space above a ceiling, in the building 200. Although in the example illustrated in FIG. 1, the relay unit 2 is installed in the space 204 in the building 200, the relay unit 2 may be installed in the outdoor space 7. The outdoor unit 1 and the relay unit 2 are connected to each other by a refrigerant pipe 5, which serves as a flow passage for heat-source-side refrigerant, whereby a refrigerant cycle circuit A is formed. The indoor units 3 and the relay unit 2 are connected to each other by heat-medium main pipes 4 to be described later (see FIG. 2), which serve as flow passages for a heat medium, whereby a heat-medium cycle circuit B is formed. As illustrated in FIG. 2 which will be referred to below, since the heat-medium main pipe 4 is provided in the relay unit 2, in FIG. 1, illustration of the heat-medium main pipe 4 is omitted. The indoor units 3*a* to 3*c* are connected to the respective heat-medium main pipes 4 via respective heat-medium branch pipes 6. The heat-medium main pipe 4 and the heat-medium branch pipe 6 form a heat medium pipe through which the heat medium flows. The relay unit 2 causes heat exchange and heat transfer to be performed between heat-source-side refrigerant that circulates in the refrigerant cycle circuit A and a heat medium that circulates in the heat-medium cycle circuit B.

As the heat-source-side refrigerant that circulates in the refrigerant cycle circuit A, for example, single-component refrigerant such as R-22 and R-134a, near-azeotropic refrigerant mixtures such as R-410A and R-404A, or zeotropic refrigerant mixtures such as R-407C can be used. Alternatively, as the heat-source-side refrigerant, refrigerant such as $CF_3CF{=}CH_2$ that has a double bond in a chemical formula or mixtures thereof can be used. These kinds of refrigerant has relatively lower global warming potentials than other existing kinds of refrigerant. In addition, as the heat-source-side refrigerant, natural refrigerant such as $CO_2$ or propane can be also used.

As the heat medium that circulates in the heat-medium cycle circuit B, for example, brine (antifreeze), water, a mixed liquid of brine and water, or a mixed liquid of a highly-anticorrosive additive and water can be used.

FIG. 2 illustrates an example of the configuration of the air-conditioning apparatus 100 according to Embodiment 1. Components of the air-conditioning apparatus 100 will be described with reference to FIG. 2.

[Outdoor Unit 1]

The outdoor unit 1 is configured to transfer heat by causing the heat-source-side refrigerant to circulate in the refrigerant cycle circuit A, and cause heat-medium heat exchangers 20*a* and 20*b* of the relay unit 2 to transfer heat between the heat-source-side refrigerant and the heat medium, that is, to cause heat exchange to be performed between the heat-source-side refrigerant and the heat medium. The outdoor unit 1 includes a compressor 10, a first refrigerant flow switching device 11, a heat-source-side heat exchanger 12, a refrigerant container 13, and a heat-source-side fan 14 that are all provided in a housing 18. The outdoor unit 1 further includes a controller 19 that controls operations that are performed in the outdoor unit 1.

The compressor 10 sucks heat-source-side refrigerant that flows in the refrigerant cycle circuit A. The compressor 10 compresses and discharges the sucked heat-source-side refrigerant. The compressor 10 is, for example, an inverter compressor.

The heat-source-side fan 14 includes a fan motor and blades. The heat-source-side fan 14 sends air to the heat-source-side heat exchanger 12.

The heat-source-side heat exchanger 12 causes heat exchange to be performed between heat-source-side refrigerant that flows in the heat-source-side heat exchanger 12 and air sent by the heat-source-side fan 14. The heat-source-side heat exchanger 12 is, for example, a fin-and-tube heat exchanger.

The first refrigerant flow switching device 11 is configured to switch the state of the first refrigerant flow switching device 11 between the state of the first refrigerant flow switching device 11 in cooling operation in which the indoor units 3 perform cooling of the indoor spaces 202 and 203 and that in heating operation in which the indoor units 3 perform heating of the indoor spaces 202 and 203. The first refrigerant flow switching device 11 is, for example, a four-way valve. The first refrigerant flow switching device 11 switches the flow of the heat-source-side refrigerant between the flow of the heat-source-side refrigerant in the cooling operation mode and that in the heating operation mode. In cooling operation, the first refrigerant flow switching device 11 is made to be in a state indicated by solid lines in FIGS. 3 and 4, which will be referred to later, whereby heat-source-side refrigerant discharged from the compressor 10 flows into the heat-source-side heat exchanger 12. At this time, the heat-source-side heat exchanger 12 operates as a condenser. On the other hand, in heating operation, the first refrigerant flow switching device 11 is made to be in a state indicated by solid lines in FIGS. 5 and 6, which will be referred to later, whereby the heat-source-side refrigerant discharged from the compressor 10 flows into at least one of the heat-medium heat exchangers 20*a* and 20*b* provided in the relay unit 2. At this time, the heat-medium heat exchangers 20*a* and 20*b*, into which the heat-source-side refrigerant has flowed, operate as condensers, and the heat-source-side heat exchanger 12 operates as an evaporator.

The refrigerant container 13 is provided on a suction side of the compressor 10. The refrigerant container 13 is a container that stores refrigerant. The refrigerant container 13 is, for example, an accumulator. The refrigerant container 13 has a function of storing surplus refrigerant and a function of separating gas refrigerant and liquid refrigerant from each other to prevent a large amount of liquid refrigerant from returning to the compressor 10.

The compressor 10, the first refrigerant flow switching device 11, the heat-source-side heat exchanger 12, the refrigerant container 13, and the heat-medium heat exchangers 20*a* and 20*b* of the relay unit 2 are connected by refrigerant pipes 5, whereby the refrigerant cycle circuit A is formed.

The refrigerant cycle circuit A further includes a first connecting pipe 15, a second connecting pipe 16, and first backflow prevention devices 17*a* to 17*d* that are provided in the outdoor unit 1. In this example, check valves are used as the first backflow prevention devices 17*a* to 17*d*.

In the outdoor unit 1, the first connecting pipe 15 connects part of the refrigerant pipe 5 that is located between the first refrigerant flow switching device 11 and the first backflow prevention device 17*c* to part of the refrigerant pipe 5 located between the first backflow prevention device 17*a* and the relay unit 2.

In the outdoor unit 1, the second connecting pipe 16 connects part of the refrigerant pipe 5 that is located between the first backflow prevention device 17*c* and the relay unit 2 to part of the refrigerant pipe 5 that is located between the heat-source-side heat exchanger 12 and the first backflow prevention device 17*a*.

Figure 5:
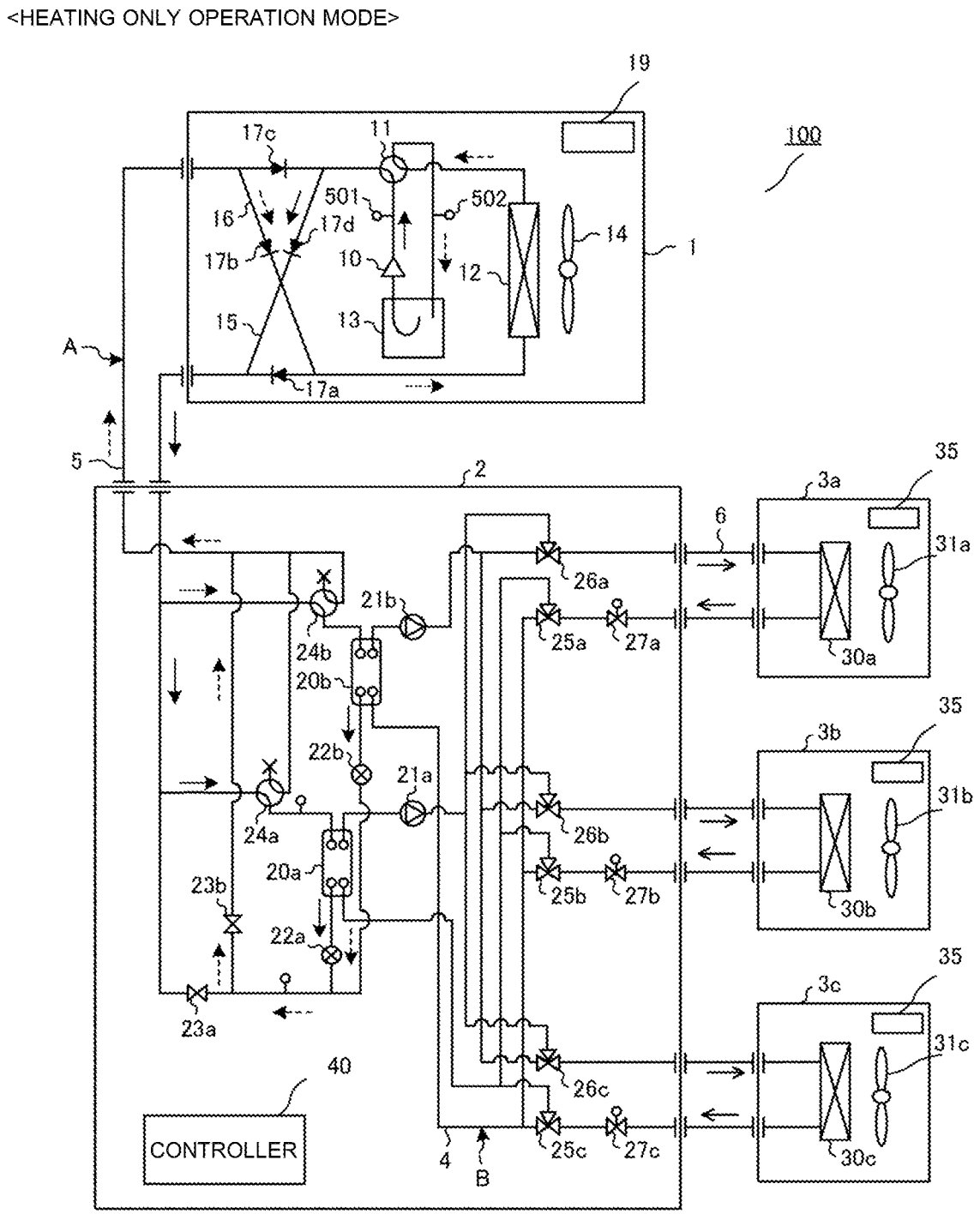
FIG. 5 is a circuit diagram illustrating the flow of the refrigerant in a heating only operation mode of the air-conditioning apparatus 100 according to Embodiment 1.
Figure 6:
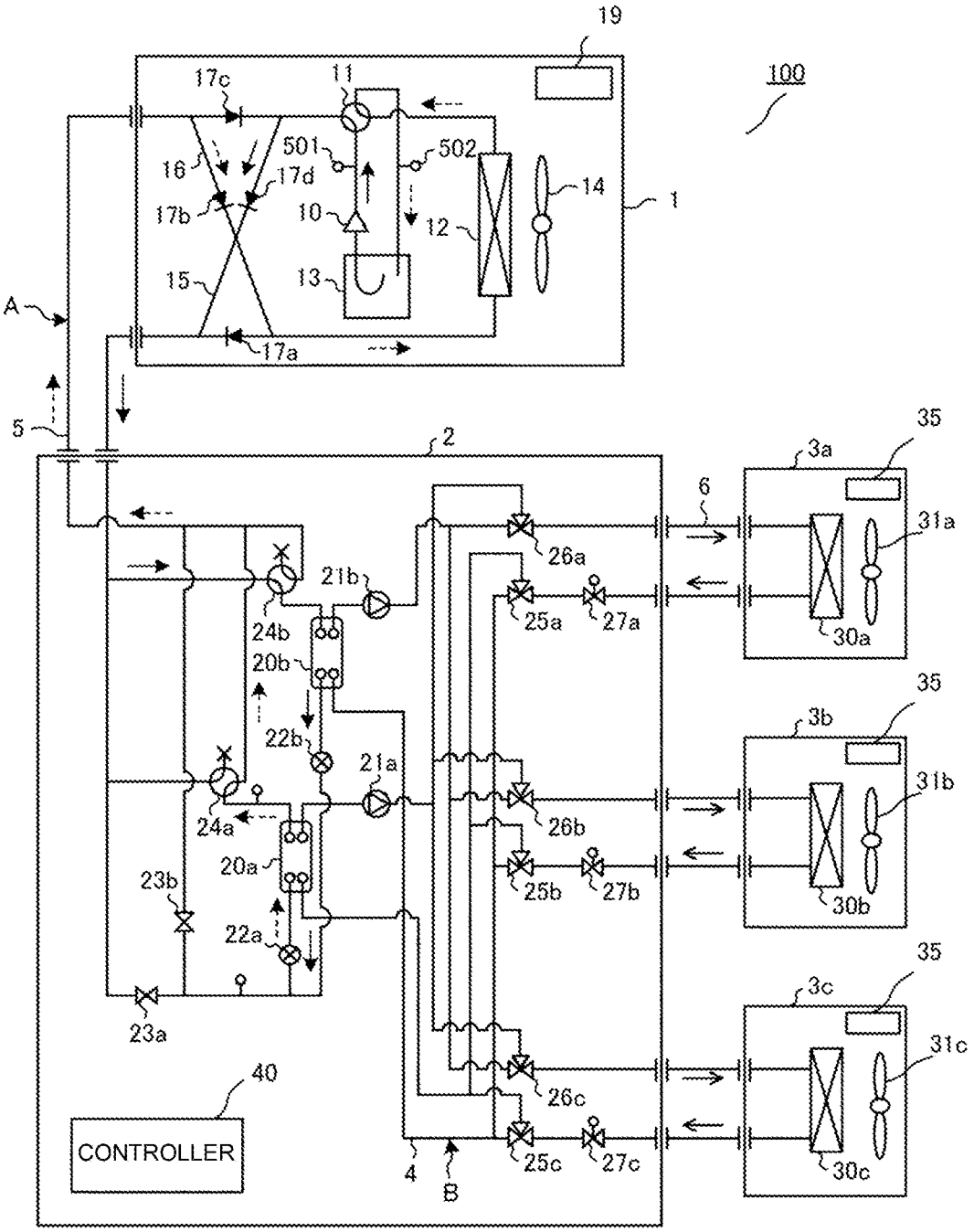
FIG. 6 is a circuit diagram illustrating the flow of the refrigerant in a heating main operation mode of the air-conditioning apparatus 100 according to Embodiment 1.

The first backflow prevention device 17*a* is provided at part of the refrigerant pipe 5 that is located between the heat-source-side heat exchanger 12 and the relay unit 2. The first backflow prevention device 17*a* is configured to prevent, in the heating only operation mode as illustrated in FIG. 5 and the heating main operation mode as illustrated in FIG. 6, high-temperature and high-pressure gas refrigerant from flowing back from the first connecting pipe 15 toward the heat-source-side heat exchanger 12.

Figure 3:
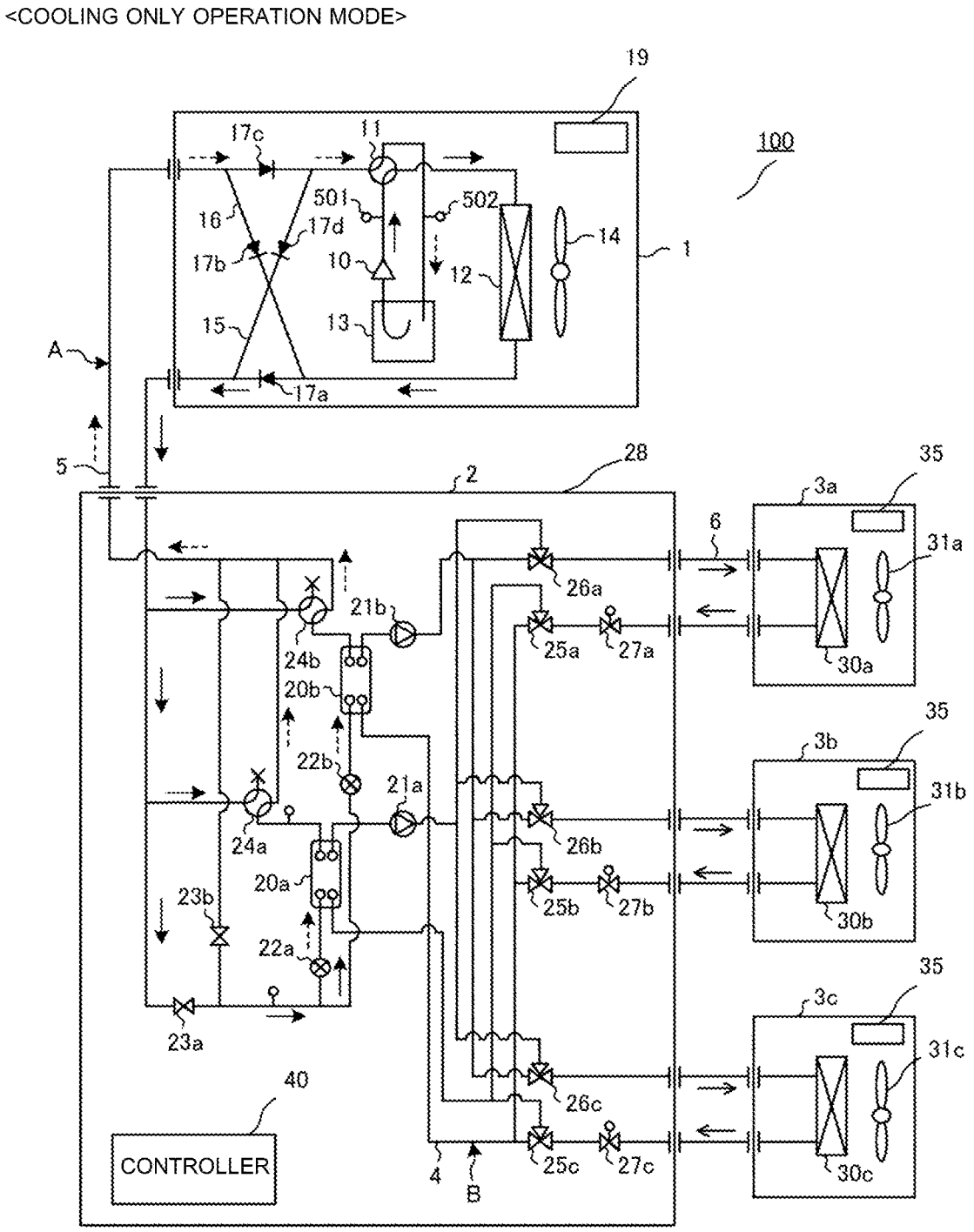
FIG. 3 is a circuit diagram illustrating the flow of refrigerant in a cooling only operation mode of the air-conditioning apparatus 100 according to Embodiment 1.
Figure 4:
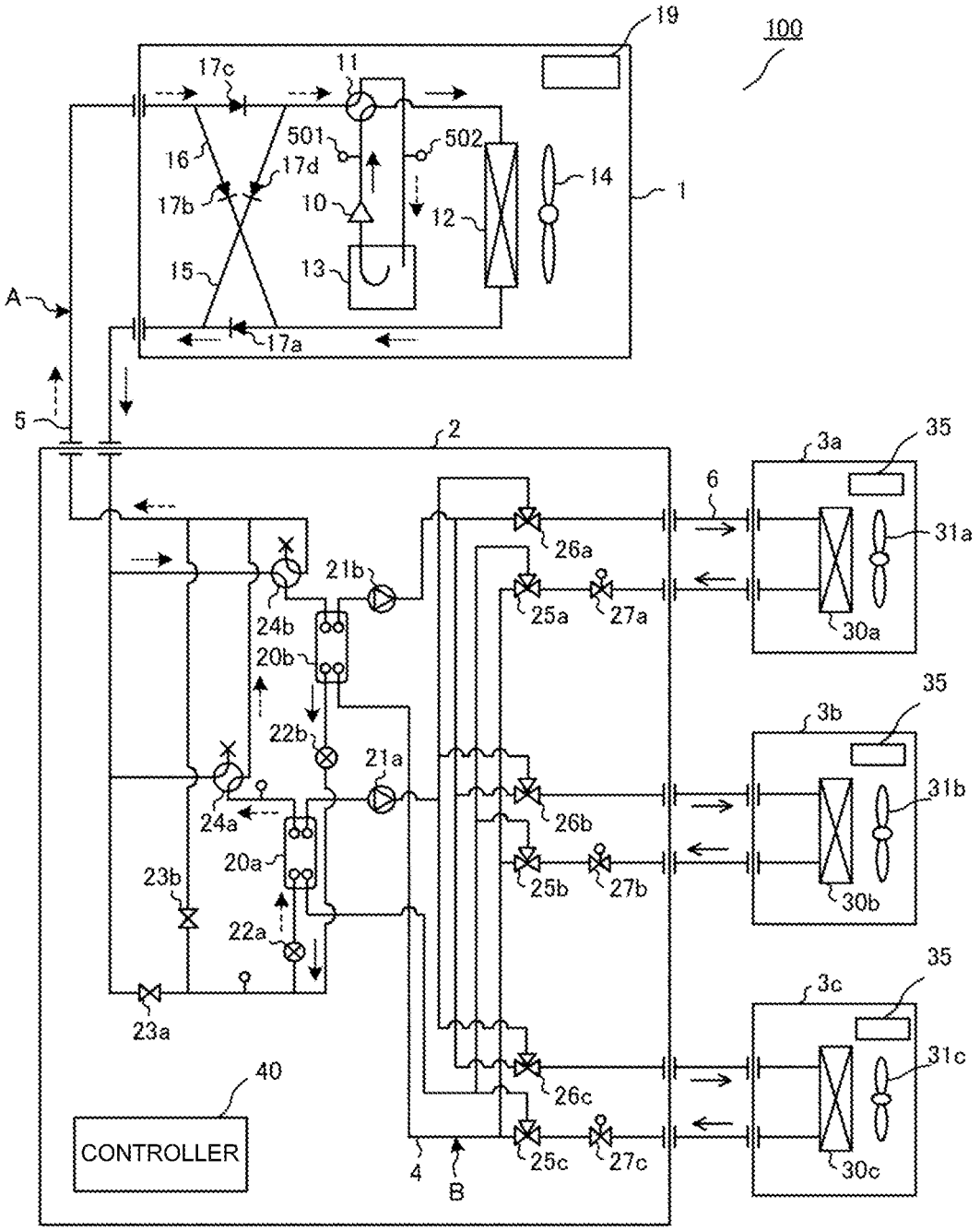
FIG. 4 is a circuit diagram illustrating the flow of the refrigerant in a cooling main operation mode of the air-conditioning apparatus 100 according to Embodiment 1.

The first backflow prevention device 17*b* is provided at the second connecting pipe 16. The first backflow prevention device 17*b* is configured to prevent, in the cooling only operation mode as illustrated in FIG. 3 and the cooling main operation mode as illustrated in FIG. 4, high-pressure liquid or two-phase gas-liquid refrigerant from flowing back from the second connecting pipe 16 toward the refrigerant container 13.

The first backflow prevention device 17*c* is provided at part of the refrigerant pipe 5 that is located between the relay unit 2 and the first refrigerant flow switching device 11. The first backflow prevention device 17*c* is configured to prevent, in the heating only operation mode as illustrated in FIG. 5 and the heating main operation mode as illustrated in FIG. 6, high-temperature and high-pressure gas refrigerant from flowing back from a flow passage on a discharge side of the compressor 10 toward the second connecting pipe 16.

The first backflow prevention device 17*d* is provided at the first connecting pipe 15. The first backflow prevention device 17*d* is configured to prevent, in the cooling only operation mode as illustrated in FIG. 3 and the cooling main operation mode as illustrated in FIG. 4, high-pressure liquid or two-phase gas-liquid refrigerant from flowing back from the first connecting pipe 15 toward the refrigerant container 13.

In such a manner, by providing the first connecting pipe 15, the second connecting pipe 16, and the first backflow prevention devices 17*a* to 17*d*, it is possible to control the flow of refrigerant that is made to flow into the relay unit 2, such that the refrigerant flows in a given direction, regardless of which operation is required by the indoor units 3. Although in this example, check valves are used as the first backflow prevention devices 17*a* to 17*d*, other kinds of devices may be used as long as they can prevent the backflow of refrigerant. For example, opening and closing devices or expansion devices having a fully-closing function, or other devices may be used as the first backflow prevention devices 17*a* to 17*d*.

The outdoor unit 1 further includes a high-pressure-side pressure sensor 501 and a low-pressure-side pressure sensor 502. The high-pressure-side pressure sensor 501 measures the pressure of heat-source-side refrigerant discharged from the compressor 10. The low-pressure-side pressure sensor 502 measures the pressure of heat-source-side refrigerant that flows into the compressor 10 via the refrigerant container 13. It should be noted that in Embodiment 1, the low-pressure-side pressure sensor 502 measures, as a low-pressure-side pressure, the pressure of heat-source-side refrigerant that flows into the refrigerant container 13. The outdoor unit 1 further includes the controller 19 configured to control operations that are performed in the outdoor unit 1.

[Indoor Unit 3]

The indoor units 3*a*, 3*b*, and 3*c* include indoor heat exchangers 30*a*, 30*b*, and 30*c* provided in housings 32*a*, 32*b*, and 32*c*, respectively. The indoor heat exchangers 30*a*, 30*b*, and 30*c* are load-side heat exchangers. Furthermore, the indoor units 3*a*, 3*b*, and 3*c* are provided with indoor fans 31*a*, 31*b*, and 31*c*, respectively. The indoor fans 31*a*, 31*b*, and 31*c* send air to the indoor heat exchangers 30*a*, 30*b*, and 30*c*. The indoor heat exchangers 30*a*, 30*b*, and 30*c* cause heat exchange to be performed between a heat medium that flow in the indoor heat exchangers 30*a*, 30*b*, and 30*c* and air sent by the indoor fans 31*a*, 31*b*, and 31*c*. The indoor heat exchangers 30*a*, 30*b*, and 30*c* are, for example, fin-and-tube heat exchangers. In cooling operation, the indoor heat exchangers 30*a*, 30*b*, and 30*c* operate as evaporators. On the other hand, in heating operation, the indoor heat exchangers 30*a*, 30*b*, and 30*c* operate as condensers. Each of the indoor units 3 further includes a controller 35 configured to control operations that are performed in the indoor unit 3.

[Relay Unit 2]

In the relay unit 2, two heat-medium heat exchangers 20 and two pumps 21 are provided in a housing 28. The heat-medium heat exchangers 20 causes heat exchange to be performed between the heat-source-side refrigerant and the heat medium. The pumps 21 transfer the heat medium from the relay unit 2 to the indoor units 3. In addition, the relay unit 2 includes a controller 40 configured to control operations that are performed in the relay unit 2.

Furthermore, in the relay unit 2, two expansion devices 22, two opening and closing devices 23, and two second refrigerant flow switching devices 24 are provided in part of the refrigerant cycle circuit A that is located in the housing 28.

Also, in the relay unit 2, three first heat-medium flow switching devices 25, three second heat-medium flow switching devices 26, and three heat-medium flow control devices 27 are provided in part of the heat-medium cycle circuit B that is located in the housing 28.

The relay unit 2 has an inlet 29*a* through which the heat-source-side refrigerant flows from the outdoor unit 1 into the relay unit 2 and an outlet 29*b* through which the heat-source-side refrigerant flows out from the relay unit 2 to the outdoor unit 1.

<Heat-Medium Heat Exchanger 20>

The heat-medium heat exchangers 20*a* and 20*b* operate as condensers (radiators) or evaporators. The heat-medium heat exchanger 20*a* is provided in part of the refrigerant cycle circuit A between an expansion device 22*a* and a second refrigerant flow switching device 24*a*. In the cooling main operation mode and the heating main operation mode, the heat-medium heat exchanger 20*a* operates as an evaporator to heat the heat medium. The heat-medium heat exchanger 20*b* is provided in part of the refrigerant cycle circuit A that is located between an expansion device 22*b* and a second refrigerant flow switching device 24*b*. In the cooling main operation mode and the heating main operation mode, the heat-medium heat exchanger 20*b* operates as a condenser to cool the heat medium. In addition, the heat-medium heat exchangers 20*a* and 20*b* operate as evaporators in the cooling only operation mode and operate as condensers in the heating only operation mode.

<Expansion Device 22>

The expansion devices 22*a* and 22*b* operate as pressure reducing valves and expansion valves, and decompress and expand the heat-source-side refrigerant. The expansion devices 22*a* and 22*b* are provided in association with the heat-medium heat exchangers 20*a* and 20*b*, respectively. The expansion device 22*a* is provided upstream of the heat-medium heat exchanger 20*a* in the flow direction of the heat-source-side refrigerant in the cooling only operation mode. The expansion device 22*b* is provided upstream of the heat-medium heat exchanger 20*b* in the flow direction of the heat-source-side refrigerant flows in the cooling only operation mode. The expansion devices 22*a* and 22*b* are, for example, electronic expansion valves whose opening degrees can be controlled.

<Opening and Closing Device 23>

The opening and closing devices 23*a* and 23*b* are, for example, two-way valves, and open and close the refrigerant pipe 5. The opening and closing device 23*a* is provided at the refrigerant pipe 5 on a side where the inlet 29*a* for the heat-source-side refrigerant is located. The opening and closing device 23*b* is provided at a bypass pipe 5*a* that connects the inlet 29*a* and the outlet 29*b* for the heat-source-side refrigerant. The bypass pipe 5*a* is part of the refrigerant pipe 5. The opening and closing devices 23*a* and 23*b* may be electronic expansion valves such as expansion devices.

<Second Refrigerant Flow Switching Device 24>

The second refrigerant flow switching devices 24*a* and 24*b* are, for example, four-way valves, and switch the flow of the heat-source-side refrigerant depending on which of the operation modes is set. The second refrigerant flow switching devices 24*a* and 24*b* are provided in association with the heat-medium heat exchangers 20*a* and 20*b*, respectively. The second refrigerant flow switching device 24*a* is provided downstream of the heat-medium heat exchanger 20*a* in the flow direction of the heat-source-side refrigerant in the cooling only operation mode. The second refrigerant flow switching device 24*b* is provided downstream of the heat-medium heat exchanger 20*b* in the flow direction of the heat-source-side refrigerant in the cooling only operation mode. To be more specific, the second refrigerant flow switching devices 24*a* and 24*b* are provided downstream of the heat-medium heat exchangers 20*a* and 20*b* in the flow direction of the heat-source-side refrigerant in the case where the heat-medium heat exchangers 20*a* and 20*b* operate as evaporators.

<Pump 21>

The pumps 21*a* and 21*b* each pressurize a heat medium that flows through the heat-medium main pipe 4 to cause the heat medium to circulate in the heat-medium cycle circuit B. The pump 21*a* is provided at part of the heat-medium main pipe 4 that is located between the heat-medium heat exchanger 20*a* and the second heat-medium flow switching devices 26*a*, 26*b*, and 26*c*. Furthermore, the pump 21*b* is provided at part of the heat-medium main pipe 4 that is located between the heat-medium heat exchanger 20*b* and the second heat-medium flow switching devices 26*a*, 26*b*, and 26*c*.

<First Heat-Medium Flow Switching Device 25>

The first heat-medium flow switching devices 25*a*, 25*b*, and 25*c* are, for example, three-way valves, and switch the flow of the heat medium. The number of the first heat-medium flow switching devices 25 corresponds to the number of the indoor units 3 installed. Each of the first heat-medium flow switching devices 25 has three flow passages one of which is connected to the heat-medium heat exchanger 20*a*. Furthermore, another one of the three flow passages is connected to the heat-medium heat exchanger 20*b*, and the remaining one of the three flow passages is connected to an associated one of the heat-medium flow control devices 27. The first heat-medium flow switching devices 25*a*, 25*b*, and 25*c* are provided on outlet sides of the indoor heat exchangers 30, that is, they are provided for outlets 33 of heat medium flow passages in the indoor heat exchangers 30.

<Second Heat-Medium Flow Switching Device 26>

The second heat-medium flow switching devices 26*a*, 26*b*, and 26*c* are, for example, three-way valves, and switch the flow of the heat medium. The number of the second heat-medium flow switching devices 26 provided corresponds to the number of the indoor units 3 installed. Each of the second heat-medium flow switching devices 26 has three flow passages one of which is connected to the heat-medium heat exchanger 20*a*. Furthermore, another one of the three flow passages is connected to the heat-medium heat exchanger 20*b*, and the remaining one of the three flow passages is connected to an associated one of the indoor heat exchangers 30*a*, 30*b*, and 30*c*. The second heat-medium flow switching devices 26*a*, 26*b*, and 26*c* are provided on inlet sides of the indoor heat exchangers 30, that is, they are provided for inlets 34 of the heat medium flow passages in the indoor heat exchangers 30.

<Heat-Medium Flow Control Device 27>

The heat-medium flow control devices 27*a*, 27*b*, and 27*c* are configured to adjust the flow rates of a heat medium that flows through the indoor units 3*a*, 3*b*, and 3*c*. Each of the heat-medium flow control devices 27*a*, 27*b*, and 27*c* is, for example, a two-way valve whose opening area can be controlled, and controls the flow rate of a heat medium that flows through a heat-medium branch pipe 6. The number of the heat-medium flow control devices 27 corresponds to the number of the indoor units 3 installed. One of ends of each of the heat-medium flow control devices 27 is connected to an associated one of the indoor heat exchangers 30 and the other is connected to an associated one of the first heat-medium flow switching devices 25. In this example, the heat-medium flow control devices 27 are provided on the outlet sides of the indoor heat exchangers 30, that is, they are provided for the outlets 33 of the heat medium flow passages in the indoor heat exchangers 30. However, the heat-medium flow control devices 27 may be provided for the inlets 34 of the heat medium flow passages in the indoor heat exchangers 30.

[Hardware Configurations of Controllers 19, 35, and 40]

Hardware configurations of the controllers 19, 35, and 40 will be described. The controllers 19, 35, and 40 are each a processing circuit. The processing circuit is dedicated hardware or a processor. The dedicated hardware is an application specific integrated circuit (ASIC) or a field programmable gate array (FPGA). The processor executes a program stored in a memory. The controllers 19, 35, and 40 each include a storage device (not illustrated). The storage device is a memory. The memory is a nonvolatile or volatile semiconductor memory such as a random-access memory (RAM), a read-only memory (ROM), a flash memory, or an erasable programmable ROM (EPROM) or a disk such as a magnetic disk, a flexible disk, or an optical disk.

It will be described with reference to FIGS. 3 to 6 how the air-conditioning apparatus 100 according to Embodiment 1 is operated in each of the operation modes.

<Cooling Only Operation Mode>

FIG. 3 is a circuit diagram illustrating the flow of refrigerant in the cooling only operation mode of the air-conditioning apparatus 100 according to Embodiment 1. In the cooling only operation mode, in both the indoor spaces 202 and 203, cooling is performed. In the cooling only operation mode, the heat-source-side heat exchanger 12 in the outdoor unit 1 operates as a condenser, and all the indoor heat exchangers 30 in the indoor units 3 operate as evaporators. Furthermore, in the cooling only operation mode, all the heat-medium heat exchangers 20 in the relay unit 2 operate as evaporators.

In the cooling only operation mode, the heat-source-side refrigerant that circulates in the refrigerant cycle circuit A is sucked into the compressor 10 and compressed by the compressor 10. Then, high-temperature and high-pressure gas refrigerant discharged from the compressor 10 flows into the heat-source-side heat exchanger 12 via the first refrigerant flow switching device 11. In the heat-source-side heat exchanger 12, the gas refrigerant transfers heat to the surrounding air and as a result, condenses and liquefies to change into high-pressure liquid refrigerant, and the liquid refrigerant passes through the first backflow prevention device 17*a* and flows out from the outdoor unit 1. Then, the liquid refrigerant passes through the refrigerant pipe 5 and flows into the relay unit 2.

The refrigerant that has flowed into the relay unit 2 passes through the opening and closing device 23*a* and expands in the expansion devices 22*a* and 22*b* to change into low-temperature and low-pressure two-phase refrigerant. The two-phase refrigerant flows into each of the heat-medium heat exchangers 20*a* and 20*b*, which operate as evaporators. In each of the heat-medium heat exchangers 20*a* and 20*b*, the two-phase refrigerant receives heat from the heat medium that circulates in the heat-medium cycle circuit B to change into low-temperature and low-pressure gas refrigerant. The gas refrigerant flows out from the relay unit 2 via the second refrigerant flow switching devices 24*a* and 24*b*. Then, the gas refrigerant passes through the refrigerant pipe 5 and re-flows into the outdoor unit 1. The refrigerant that has flowed into the outdoor unit 1 passes through the first backflow prevention device 17*c* and is re-sucked into the compressor 10 via the first refrigerant flow switching device 11 and the refrigerant container 13.

In the heat-medium cycle circuit B, the heat medium is cooled in each of the heat-medium heat exchangers 20*a* and 20*b* by the heat-source-side refrigerant that circulates in the refrigerant cycle circuit A. The cooled heat medium is caused by the pumps 21*a* and 21*b* to flow through the heat-medium main pipe 4 and the heat-medium branch pipes 6. The heat medium flows into the indoor heat exchangers 30*a* to 30*c* via the second heat-medium flow switching devices 26*a* to 26*c*. In each of the indoor heat exchangers 30*a* to 30*c*, the heat medium receives heat from indoor air. As a result, the indoor air is cooled to cool the indoor spaces 202 and 203, which are the air-conditioning target spaces. The heat medium that has flowed out from the indoor heat exchangers 30*a* to 30*c* flows into the heat-medium flow control devices 27*a* to 27*c*. Then, the heat medium passes through the first heat-medium flow switching devices 25*a* to 25*c*, flows into the heat-medium heat exchangers 20*a* and 20*b*, and are then cooled. After that, the heat medium is re-sucked into the pumps 21*a* and 21*b*. It should be noted that when no thermal loads are applied onto the indoor heat exchangers 30*a* to 30*c*, the heat-medium flow control devices 27*a* to 27*c* associated with the indoor heat exchangers 30*a* to 30*c* are fully closed. Furthermore, when thermal loads are applied onto the indoor heat exchangers 30*a* to 30*c*, the opening degrees of the heat-medium flow control devices 27*a* to 27*c* are adjusted, whereby the thermal loads onto the indoor heat exchangers 30*a* to 30*c* are adjusted.

<Cooling Main Operation Mode>

FIG. 4 is a circuit diagram illustrating the flow of refrigerant in the cooling main operation mode of the air-conditioning apparatus according to Embodiment 1. The cooling main operation mode is a mode in which one or more of the indoor units perform cooling operation and the other one or ones of the indoor units perform heating operation, and is basically a mode in which the cooling load on all the indoor units is higher than heating load on all the indoor units. That is, in the cooling main operation mode, of the indoor spaces 202 and 203 which are the air-conditioning target spaces, an indoor space is cooled in the case where a cooling request for this indoor space is made, and an indoor space is heated in the case where a heating request for this indoor space is made. In this regard, the cooling main operation mode is different from the cooling only operation mode described with reference to FIG. 3. In the cooling main operation mode, the heat-source-side heat exchanger 12 of the outdoor unit 1 operates as a condenser. Furthermore, in the cooling main operation mode, of the plurality of indoor heat exchangers 30, an indoor heat exchanger 30 operates as an evaporator in the case where a cooling request for an indoor space where this indoor heat exchanger 30 is located is made, and an indoor heat exchanger 30 operates as a condenser in the case where a heat request for an indoor unit including this indoor heat exchanger 30 is made. In the cooling main operation mode, one or more of the plurality of heat-medium heat exchangers 20 operate as condensers, and the other or others of the plurality of heat-medium heat exchangers 20 operate as evaporators. In Embodiment 1, the heat-medium heat exchanger 20*b* operates as a condenser, and the heat-medium heat exchanger 20*a* operates as an evaporator.

In the cooling main operation mode, high-temperature and high-pressure gas refrigerant discharged from the compressor 10 flows into the heat-source-side heat exchanger 12 via the first refrigerant flow switching device 11. In the heat-source-side heat exchanger 12, the gas refrigerant transfers heat to the surrounding air and thus condenses to change into two-phase refrigerant. The two-phase refrigerant passes through the first backflow prevention device 17*a* and flows out from the outdoor unit 1. Then, the two-phase refrigerant passes through the refrigerant pipe 5 and flows into the relay unit 2. As indicated by solid arrows, the two-phase refrigerant that has flowed into the relay unit 2 passes through the second refrigerant flow switching device 24*b* and flows into the heat-medium heat exchanger 20*b*, which operates as a condenser. In the heat-medium heat exchanger 20*b*, the two-phase refrigerant transfers heat to the heat medium that circulates in the heat-medium cycle circuit B, to change into high-pressure liquid refrigerant. The high-pressure liquid refrigerant is expanded by the expansion device 22*b* to change into low-temperature and low-pressure two-phase refrigerant. Next, as indicated by dotted arrows, the two-phase refrigerant flows into the heat-medium heat exchanger 20*a*, which operates as an evaporator, via the expansion device 22*a*. In the heat-medium heat exchanger 20*a*, the two-phase refrigerant receives heat from the heat medium that circulates in the heat-medium cycle circuit B, to change into low-pressure gas refrigerant. The gas refrigerant flows out from the relay unit 2 via the second refrigerant flow switching device 24*a*. Then, the gas refrigerant passes through the refrigerant pipe 5 and re-flows into the outdoor unit 1. The gas refrigerant that has flowed into the outdoor unit 1 passes through the first backflow prevention device 17*c* and is re-sucked into the compressor 10 via the first refrigerant flow switching device 11 and the refrigerant container 13.

In the heat-medium cycle circuit B, heating energy of the heat-source-side refrigerant is transferred to the heat medium in the heat-medium heat exchanger 20*b*. Then, the heat medium heated is caused by the pump 21*b* to flow through the heat-medium main pipe 4 and the heat-medium branch pipes 6. The first heat-medium flow switching devices 25*a* to 25*c* and the second heat-medium flow switching devices 26*a* to 26*c* are operated, and a heat medium that has flowed into the indoor heat exchangers 30*a* to 30*c* located in indoor spaces for which heating requests are made transfers heat to indoor air. The indoor air is heated and thus heats the indoor space 202 or 203 to be air-conditioned. On the other hand, in the heat-medium heat exchanger 20*a*, cooling energy of the heat-source-side refrigerant is transferred to the heat medium. Then, the heat medium cooled is caused by the pump 21*a* to flow through the heat-medium main pipe 4 and the heat-medium branch pipes 6. The first heat-medium flow switching devices 25*a* to 25*c* and the second heat-medium flow switching devices 26*a* to 26*c* are operated, and a heat medium that has flowed into the indoor heat exchangers 30*a* to 30*c* included in the indoor units 1 to which cooling requests are made receives heat from indoor air of the indoor space 202 or 203. The indoor air is cooled and thus cools the indoor space 202 or 203 to be air-conditioned. It should be noted that when no thermal loads are applied onto the indoor heat exchangers 30*a* to 30*c*, the associated heat-medium flow control devices 27*a* to 27*c* are totally closed. Furthermore, when no thermal loads are applied onto the indoor heat exchangers 30*a* to 30*c*, the opening degrees of the heat-medium flow control devices 27*a* to 27*c*, which are associated with the indoor heat exchangers 30*a* to 30*c*, are adjusted, whereby the thermal loads onto the indoor heat exchangers 30*a* to 30*c* are adjusted.

<Heating Only Operation Mode>

FIG. 5 is a circuit diagram illustrating the flow of refrigerant in the heating only operation mode of the air-conditioning apparatus 100 according to Embodiment 1. In the heating only operation mode, in both the indoor spaces 202 and 203, heating is performed. In the heating only operation mode, the heat-source-side heat exchanger 12 in the outdoor unit 1 operates as an evaporator. Furthermore, in the heating only operation mode, all the indoor heat exchangers 30 in the indoor units 3 operate as condensers. In addition, in the heating only operation mode, all the heat-medium heat exchangers 20 in the relay unit 2 operate as condensers.

In the heating only operation mode, high-temperature and high-pressure gas refrigerant discharged from the compressor 10 passes through the first connecting pipe 15 and the first backflow prevention device 17*d* via the first refrigerant flow switching device 11 and flows out from the outdoor unit 1. Then, the gas refrigerant passes through the refrigerant pipe 5 and flows into the relay unit 2. As indicated by solid arrows, the gas refrigerant that has flowed into the relay unit 2 passes through the second refrigerant flow switching devices 24*a* and 24*b* and flows into each of the heat-medium heat exchangers 20*a* and 20*b*. In each of the heat-medium heat exchangers 20*a* and 20*b*, the gas refrigerant transfers heat to the heat medium that circulates in the heat-medium cycle circuit B, to change into high-pressure liquid refrigerant. The high-pressure liquid refrigerant is expanded by the expansion devices 22*a* and 22*b* to change into low-temperature and low-pressure two-phase refrigerant. As indicated by dotted arrows, the two-phase refrigerant passes through the opening and closing device 23*b* and flows out from the relay unit 2. Then, the two-phase refrigerant passes through the refrigerant pipe 5 and re-flows into the outdoor unit 1. The refrigerant that has flowed into the outdoor unit 1 passes through the second connecting pipe 16 and the first backflow prevention device 17*b* and flows into the heat-source-side heat exchanger 12, which operates as an evaporator. In the heat-source-side heat exchanger 12, the refrigerant receives heat from the surrounding air to change into low-temperature and low-pressure gas refrigerant. The gas refrigerant is re-suctioned into the compressor 10 via the first refrigerant flow switching device 11 and the refrigerant container 13. It should be noted that the movement of the heat medium in the heat-medium cycle circuit B is basically the same as that in the cooling only operation mode. However, in the heating only operation mode, the heat-medium heat exchangers 20*a* and 20*b* operate as condensers. Therefore, in the heat-medium heat exchangers 20*a* and 20*b*, the heat medium is heated by the heat-source-side refrigerant and transfers heat to indoor air in the indoor heat exchangers 30*a* and 30*b*, and heating of the indoor spaces 202 and 203 to be air-conditioned is thus performed.

<Heating Main Operation Mode>

FIG. 6 is a circuit diagram illustrating the flow of refrigerant in the heating main operation mode of the air-conditioning apparatus 100 according to Embodiment 1. The heating main operation mode is a mode in which one or more of the plurality of indoor units perform cooling operation and the other one or ones of the plurality of indoor units perform heating operation, and is basically a mode in which the heating load on all the indoor units is higher than the cooling load on all the indoor units. That is, in the heating main operation mode, of the indoor spaces 202 and 203 to be air-conditioned, an indoor space is heated in the case where a heating request for this indoor space is made, and an indoor space is cooled in the case where a cooling request for this indoor space is made. In this regard, the heating main operation mode is different from the heating only operation mode described with reference to FIG. 5. In the heating main operation mode, the heat-source-side heat exchanger 12 of the outdoor unit 1 operates as an evaporator. Furthermore, in the heating main operation mode, of the plurality of indoor heat exchangers 30, an indoor heat exchanger 30 included in an indoor unit to which a cooling request is made operates as an evaporator, and an indoor heat exchanger 30 included in an indoor unit to which a heating request is made operates as a condenser. Furthermore, in the heating main operation mode, one or more of the plurality of heat-medium heat exchangers 20 operate as condensers, and the other or others of the plurality of heat-medium heat exchangers 20 operate as evaporators. In Embodiment 1, the heat-medium heat exchanger 20*b* operates as a condenser, and the heat-medium heat exchanger 20*a* operates as an evaporator.

In the heating main operation mode, high-temperature and high-pressure gas refrigerant discharged from the compressor 10 passes through the first connecting pipe 15 and the first backflow prevention device 17*d* via the first refrigerant flow switching device 11 and flows out from the outdoor unit 1. Then, the gas refrigerant passes through the refrigerant pipe 5 and flows into the relay unit 2. As indicated by solid arrows, the refrigerant that has flowed into the relay unit 2 passes through the second refrigerant flow switching device 24*b* and flows into the heat-medium heat exchanger 20*b*, which operates as a condenser. In the heat-medium heat exchanger 20*b*, the refrigerant transfers heat to the heat medium that circulates in the heat-medium cycle circuit b, to change into high-pressure liquid refrigerant. The high-pressure liquid refrigerant is expanded by the expansion device 22*b* to change into low-temperature and low-pressure two-phase refrigerant. Next, as indicated by dotted arrows, the two-phase refrigerant flows into the heat-medium heat exchanger 20*a*, which operates as an evaporator, via the expansion device 22*a*. In the heat-medium heat exchanger 20*a*, the two-phase refrigerant receives heat from the heat medium that circulates in the heat-medium cycle circuit B and flows out from the relay unit 2 via the second refrigerant flow switching device 24*a*. Then, the two-phase refrigerant passes through the refrigerant pipe 5 and re-flows into the outdoor unit 1. The refrigerant that has flowed into the outdoor unit 1 passes through the second connecting pipe 16 and the first backflow prevention device 17*b* and flows into the heat-source-side heat exchanger 12, which operates as an evaporator. In the heat-source-side heat exchanger 12, the refrigerant receives heat from the surrounding air to change into low-temperature and low-pressure gas refrigerant. The gas refrigerant is re-sucked into the compressor 10 via the first refrigerant flow switching device 11 and the refrigerant container 13. It should be noted that the movement of the heat medium in the heat-medium cycle circuit B and the operations of the first heat-medium flow switching devices 25*a* to 25*c*, the second heat-medium flow switching devices 26*a* to 26*c*, the heat-medium flow control devices 27*a* to 27*c*, and the indoor heat exchangers 30*a* to 30*c* are basically the same as those in the cooling main operation mode.

<Switching Operation of Second Refrigerant Flow Switching Device 24>

It will be described how the controller 40 of the relay unit 2 is operated to cause each of the second refrigerant flow switching devices 24 in the air-conditioning apparatus 100 according to Embodiment 1 to perform its switching operation.

In the air-conditioning apparatus 100 according to Embodiment 1, for example, in the heating only operation mode, the heat-medium heat exchangers 20*a* and 20*b* of the relay unit 2 operate as condensers. Refrigerant that has flowed into the heat-medium heat exchangers 20*a* and 20*b* transfers heat to the heat medium that circulates in the heat-medium cycle circuit B, to change into high-pressure liquid refrigerant. The high-pressure liquid refrigerant is expanded by the expansion devices 22*a* and 22*b* into low-temperature and low-pressure two-phase refrigerant. Therefore, in the relay unit 2, part of the refrigerant pipe 5 that is located between each of the second refrigerant flow switching devices 24*a* and 24*b* and an associated one of the expansion devices 22*a* and 22*b* is a location where the high-pressure refrigerant stays. At this time, when the operation mode is switched from the heating only operation mode, for example, to the cooling only operation mode, the high-pressure refrigerant staying at the above location flows into part of the refrigerant pipe 5 that is located downstream of the location.

However, in an existing air-conditioning apparatus, when the second refrigerant flow switching devices 24*a* and 24*b* of the relay unit 2 perform their switching operations, a control to open the expansion devices 22*a* and 22*b* to let out the high-pressure refrigerant is not performed. Thus, the switching operations of the second refrigerant flow switching devices 24*a* and 24*b* are performed, with a great pressure difference made, and as a result the high-pressure refrigerant that stays in the refrigerant pipe 5 abruptly flows into low-pressure pipes. Therefore, an impact is transmitted to the refrigerant pipe 5 to cause pipe vibration.

By contrast, in Embodiment 1, the controller 40 of the relay unit 2 acquires a first detection value and a second detection value from the high-pressure-side and low-pressure-side pressure sensors 501 and 502 of the outdoor unit 1. The controller 40 determines whether pipe vibration will occur or not based on the ratio between the first detection value and the second detection value. When determining that pipe vibration will not occur, the controller 40 controls the second refrigerant flow switching devices 24*a* and 24*b* to perform their switching operations. By contrast, when determining that pipe vibration will occur, the controller 40 performs a process of letting out the high-pressure refrigerant by adjusting the opening degrees of the expansion devices 22*a* and 22*b* of the relay unit 2. After that, the controller 40 controls the second refrigerant flow switching devices 24*a* and 24*b* to perform their switching operations. Because of the above control by the controller 40, even when the switching operations of the second refrigerant flow switching devices 24*a* and 24*b* are performed according to switching of the operation mode of the air-conditioning apparatus 100, pipe vibration does not occur since the energy drain of the refrigerant is reduced.

It will be described by way of example how the controller 40 of the relay unit 2 acquires a first detection value and a second detection value from the high-pressure-side and low-pressure-side pressure sensors 501 and 502 of the outdoor unit 1 will be described. A user performs an operation to switch the operation mode of an indoor unit 3. In response to this operation, the controller 35 of the indoor unit 3 sends, to the controller 40 of the relay unit 2, a transmission signal indicating that a request for switching the operation mode is made. The controller 40 of the relay unit 2 and the controller 35 of the indoor unit 3 are connected to each other such that these controllers can communicate with each other, and they communicate with each other wirelessly or by a line for communication. Furthermore, similarly, the controller 40 of the relay unit 2 and the controller 19 of the outdoor unit 1 are connected to each other such that these controllers can communicate with each other, and they communicate with each other wirelessly or a line for communication. When receiving the transmission signal, the controller 40 of the relay unit 2 sends, to the controller 19 of the outdoor unit 1, a command to request transmission of first and second detection values obtained by the high-pressure-side and low-pressure-side pressure sensors 501 and 502. Upon reception of the command from the controller 40 of the relay unit 2, the controller 19 of the outdoor unit 1 sends, to the controller 40 of the relay unit 2, the first and second detection values obtained by the high-pressure-side and low-pressure-side pressure sensors 501 and 502.

Figure 7:
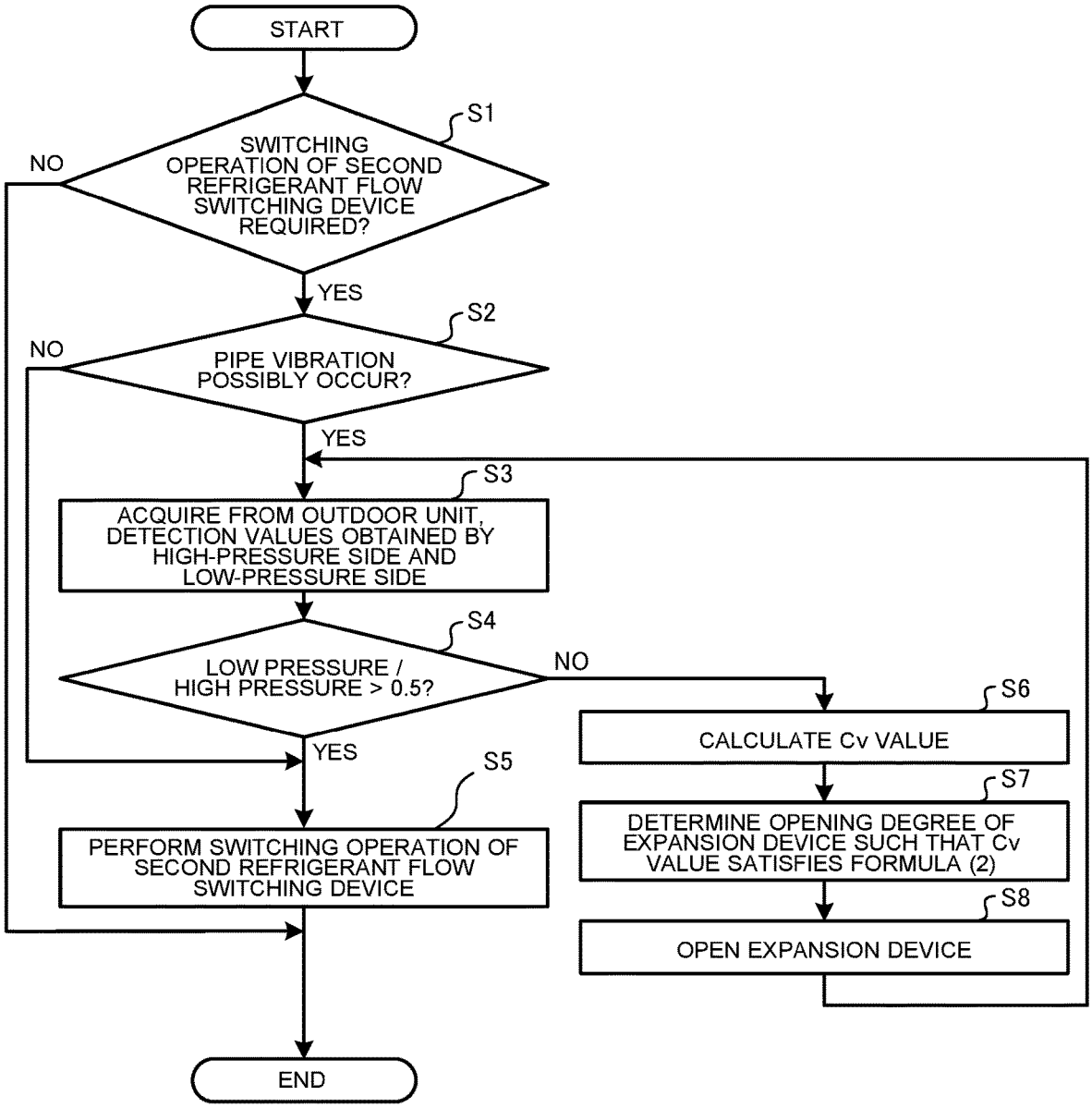
FIG. 7 is a flow chart indicating the flow of processes by a controller 40 of a relay unit 2 in the air-conditioning apparatus 100 according to Embodiment 1.

FIG. 7 is a flow chart indicating the flow of processes by the controller 40 of the relay unit 2 in the air-conditioning apparatus 100 according to Embodiment 1. FIG. 7 indicates the flow of control that is performed when the controller 40 of the relay unit 2 causes a second refrigerant flow switching device 24 to perform its switching operation.

In step S1, when the operation mode of the air-conditioning apparatus 100 is required to be switched, the controller 40 determines, based on information on which switching of the operation mode is to be performed, whether it is necessary to switch the second refrigerant flow switching device 24 or not. When the controller 40 determines that it is necessary to switch the second refrigerant flow switching device 24, the processing by the controller 40 proceeds to step S2. By contrast, when the controller 40 determines that it is not necessary to switch the second refrigerant flow switching device 24, the controller 40 ends the processing indicated by FIG. 7.

In step S2, the controller 40 determines whether switching of the operation mode corresponds to switching that may cause pipe vibration or not. In Embodiment 1, pipe vibration may occur when the switching of the operation mode corresponds to any of switching (a) to switching (e) as indicated below. Therefore, the controller 40 determines to which of the switching (a) to the switching (e) the switching of the operation mode corresponds. When it is determined that the switching of the operation mode corresponds to any of the switching (a) to the switching (e), the processing by the controller 40 proceeds to step S3. By contrast, when it is determined that the switching of the operation mode does not correspond to any of the switching (a) to the switching (e), the processing by the controller 40 proceeds to step S5.

(a) The operation mode is switched from the heating only operation mode to the cooling only operation mode.

(b) The operation mode is switched from the heating only operation mode to the cooling main operation mode.

(c) The operation mode is switched from the heating only operation mode to the heating main operation mode.

(d) The operation mode is switched from the heating main operation mode to the cooling only operation mode.

(e) The operation mode is switched from the cooling main operation mode to the cooling only operation mode.

It should be noted that the above switching (a) to the switching (e) of the operation mode all correspond to switching of the operation mode in which a heat-medium heat exchanger 20 operating as a condenser is caused to start to operate as an evaporator.

In step S3, the controller 40 acquires, from the outdoor unit 1, a second detection value obtained by the high-pressure-side pressure sensor 501 and a first detection value obtained by the low-pressure-side pressure sensor 502.

Next, in step S4, the controller 40 determines whether formula (1) indicated below is satisfied or not using the second detection value obtained by the high-pressure-side pressure sensor 501 and the first detection value obtained by the low-pressure-side pressure sensor 502. That is, the controller 40 determines whether the ratio of the first detection value to the second detection value is higher than a first threshold. In this example, the first threshold is 0.5. It should be noted that the first threshold is not limited to 0.5 but may be determined as appropriate, for example, according to the internal configuration of the relay unit 2.

[Math. 1]

$$\frac{P1}{P2} > 0.5 \text{ ( = First Treshold)} \quad (1)$$

It should be noted that P1 is the first detection value obtained by the low-pressure-side pressure sensor 502, and P2 is the second detection value obtained by the high-pressure-side pressure sensor 501.

When the controller 40 determines that the ratio of the first detection value P1 to the second detection value P2 satisfies the formula (1), the processing by the controller 40 proceeds to step S5. By contrast, when the controller 40 determines that the formula (1) is not satisfied, the processing by the controller 40 proceeds to step S6.

In step S5, the controller 40 controls the second refrigerant flow switching device 24 to perform the switching operation thereof based on to which switching the switching of the operation mode corresponds.

In step S6, the controller 40 calculates Cv values of the expansion devices 22*a* and 22*b* to let out the high-pressure refrigerant. The Cv values are numerical values that indicate the volumes of heat-source-side refrigerant that passes through the expansion devices 22*a* and 22*b*. The Cv values can be used as indices that indicate the opening degrees of the expansion devices 22*a* and 22*b* or pressure losses unique to the valves of the expansion devices 22*a* and 22*b*. The Cv values are uncertain and variable. Specifically, the Cv values vary depending on the difference ΔP between the second detection value P2 of the high-pressure-side pressure sensor 501 and the first detection value P1 of the low-pressure-side pressure sensor 502.

In step S7, the controller 40 determines the opening degrees of the expansion devices 22*a* and 22*b* such that the Cv values satisfy formula (2) below. It should be noted that when the formula (2) is not satisfied, pipe vibration occurs. Therefore, when the opening degree of the expansion device 22 is determined such that the Cv value satisfies the formula (2), it is possible to reduce occurrence of pipe vibration.

[Math. 2]

$$Cv < k \times \sqrt{\Delta P(av^2 + bv + c)} \quad (2)$$

It should be noted that Cv is a specified value of the opening degree of the expansion device 22, ΔP (=P2–P1) is the difference between the first detection value P1 of the low-pressure-side pressure sensor 502 and the second detection value P2 of the high-pressure-side pressure sensor 501, v is the flow velocity at which high-pressure refrigerant staying at the location explained above flows into a low-pressure pipe located downstream of the location, and k, a, b, and c are coefficients.

Figure 9:
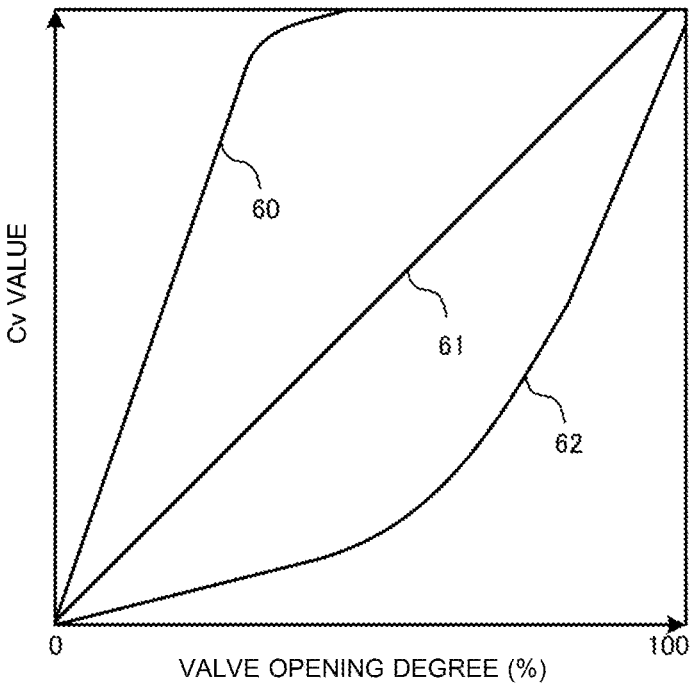
FIG. 9 is a diagram indicating a relationship between a valve opening degree and the Cv value.

FIG. 9 indicates a relationship between the valve opening degree and the Cv value. As indicated in FIG. 9, the relationship between the valve opening degree and the Cv value varies depending on the characteristics of valves. In FIG. 9, solid lines 60, 61, and 62 indicate the above relationship in the case where the characteristic is a quick opening characteristic, that in the case where the characteristic is a linear characteristic, and that in the case where the characteristic is an equal percentage characteristic, respectively. The quick opening characteristic as indicated by the solid line 60 is featured in that when the valve starts to open, the Cv value abruptly increases. The linear characteristic as indicated by the solid line 61 is featured in that the Cv value varies in proportion to the valve opening degree. The equal percentage characteristic as indicated by the solid line 62 is featured in that the equal percentage of the Cv value increases as the valve opening degree increases by equal amount. In such a manner, the relationship between the valve opening degree and the Cv value varies depending on the characteristic of the valve. Thus, a calculation formula or a data table defining the relationship between the valve opening degree and the Cv value as indicated in FIG. 9 is prepared in advance based on the characteristic of the valve of the expansion device 22. The controller 40 calculates the opening degree of the expansion device 22 from the Cv value, using the calculation formula or the data table.

As can be seen from FIG. 9, when the Cv value increases, the opening degree of the valve also increases, in any case, regardless of the characteristic of the valve. Furthermore, as can be seen from FIG. 8, when the Cv value increases, the refrigerant flow velocity v increases. In order that the refrigerant flow velocity v be less than or equal to a specified value with to prevent occurrence of pipe vibration, it is necessary to determine the opening degree of the expansion device 22 as an opening degree less than a second threshold, such that the Cv value satisfies the formula (2). The second threshold is a value determined based on the Cv value that satisfies the formula (2). In order to determine the second threshold from the Cv value, it suffices that the second threshold is calculated from the Cv value using the calculation formula or data table for calculating the valve opening degree from the Cv value.

Alternatively, the second threshold may be calculated in the following manner. As described, the Cv value is an index that indicates the valve opening degree or the pressure loss unique to the valve. As described with reference to FIG. 9, when the Cv value increases, the opening degree of the expansion device 22 also increases. Therefore, the variation of the Cv value and that of the opening degree of the expansion device 22 show similar tendencies. It is therefore possible to determine the second threshold for the opening degree of the expansion device 22 by appropriately selecting the coefficients k, a, b, and c of the formula (2). That is, the second threshold for the opening degree of the expansion device 22 can be expressed by the following formula (3). It should be noted that $k_1$, $a_1$, $b_1$, and $c_1$ are coefficients and the other parameters are the same as those of the formula (2).

[Math. 3]

$$\text{Opening Degree of Expansion Device 22} < k_1 \times \sqrt{\Delta P(a_1 v^2 + b_1 v + c_1)} \text{ ( = Second Threshold)} \quad (3)$$

As indicated in the formula (3), the second threshold is calculated based on the difference ΔP between the first detection value P1 of the low-pressure-side pressure sensor 502 and the second detection value P2 of the high-pressure-side pressure sensor 501. To be more specific, the second threshold is calculated based on the difference ΔP and the refrigerant flow velocity v. Thus, in the case where the second threshold is indicated by the right-hand side of the formula (3), the second threshold may be calculated using the right-hand side.

Next, in step S8, the controller 40 adjusts the opening degree of the expansion device 22 such that the opening degree is set to the opening degree determined in step S3. After the process of step S8 ends, the processing by the controller 40 returns to the process of step S3. It should be noted that not all the opening degrees of the expansion devices 22 need to be adjusted. That is, in the case where a heat-medium heat exchanger 20 that is directly connected to an expansion device 22 and operates as a condenser is changed to operate as an evaporator, the opening degree of an expansion device 22 is adjusted.

In step S3, the controller 40 re-acquires the second detection value P2 of the high-pressure-side pressure sensor 501 of the outdoor unit 1 and the first detection value P1 of the low-pressure-side pressure sensor 502 of the outdoor unit 1. Next, in step S4, the controller 40 determines whether the formula (1) is satisfied, and when the formula (1) is satisfied, the processing by the controller 40 proceeds to step S5, and the controller 40 causes the second refrigerant flow switching device 24 to perform the switching operation thereof.

Figure 10:
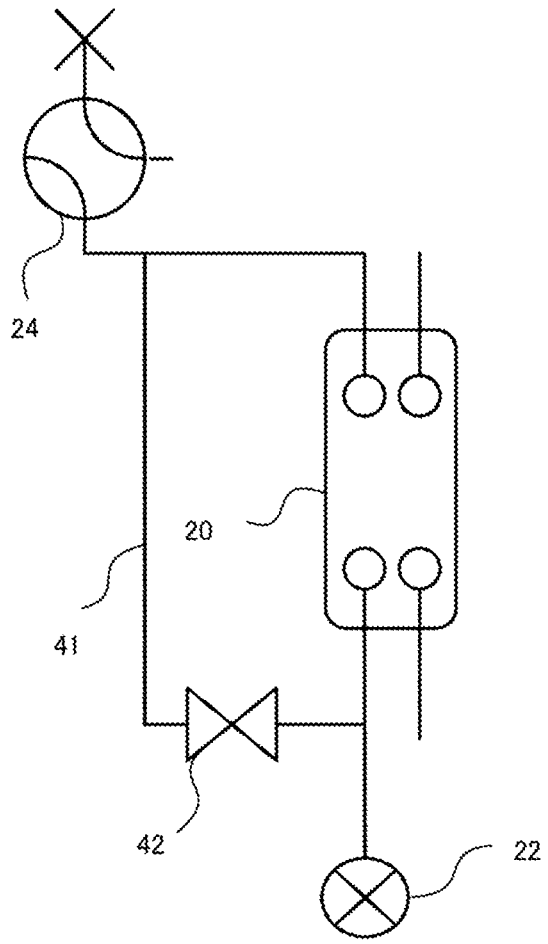
FIG. 10 is a diagram illustrating an example of the case where an additional opening and closing device 42 is further provided in the relay unit 2 of the air-conditioning apparatus 100 according to Embodiment 1.

It should be noted that in processing the flow of which is indicated in FIG. 7, in the case where the second detection value P2 of the high-pressure-side pressure sensor 501 of the outdoor unit 1 and the first detection value P1 of the low-pressure-side pressure sensor 502 of the outdoor unit 1 cannot be acquired, a time constraint may be set. Furthermore, in the case where it takes long time to satisfy the formula (1) with only one expansion device 22, an additional expansion value or opening and closing device may be further provided to shorten the time. FIG. 10 illustrates an example of the case where an additional opening and closing device 42 is further provided in the relay unit 2 of the air-conditioning apparatus 100 according to Embodiment 1. As illustrated in FIG. 10, for example, a bypass pipe 41 is provided in parallel with the heat-medium heat exchanger 20. The bypass pipe 41 is a bypass pipe that connects part of the refrigerant pipe 5 that is located between the heat-medium heat exchanger 20 and the second refrigerant flow switching device 24 and part of the refrigerant pipe 5 that is located between the heat-medium heat exchanger 20 and the expansion device 22. Moreover, an opening and closing device 42 is provided at the bypass pipe 41. The opening and closing device 42 is, for example, an on-off valve. In the case where it takes long time to satisfy the formula (1) even if the opening degree of the expansion device 22 only is adjusted, the time required to satisfy the formula (1) is shortened by adjusting the opening degree of the opening and closing device 42 at the same time as the opening degree of the expansion device 22.

Figure 8:
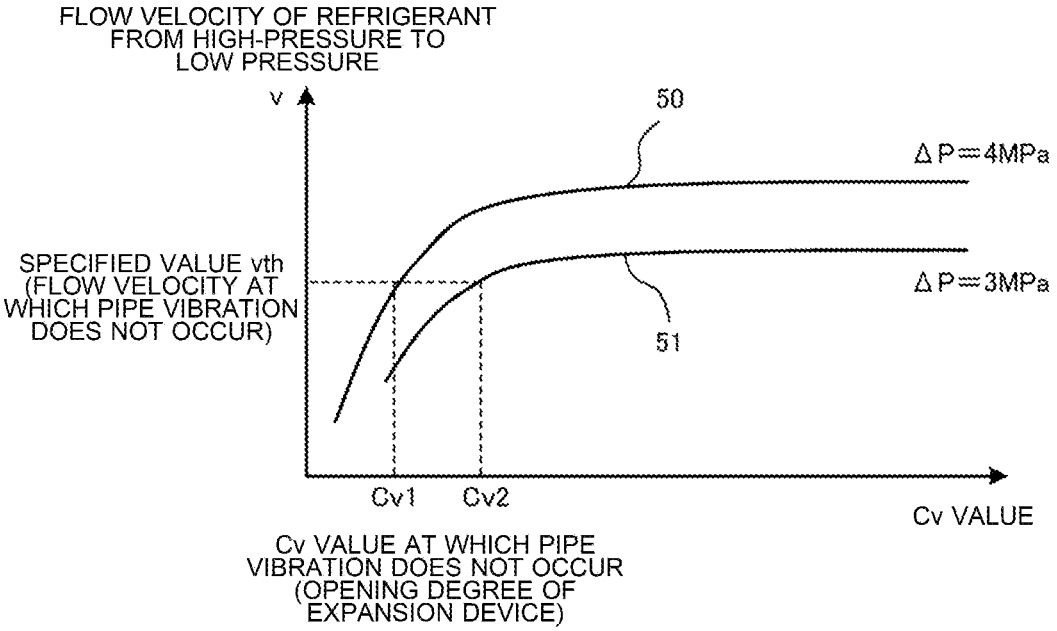
FIG. 8 is a diagram indicating a relationship between a refrigerant flow velocity v and a Cv value of an expansion device 22 according to formula (2).

FIG. 8 indicates a relationship between the refrigerant flow velocity v and the Cv value of the expansion device 22 that is associated with the formula (2). The vertical axis represents the refrigerant flow velocity v at which the high-pressure refrigerant flows into the low-pressure pipe, and the horizontal axis represents the Cv value of the expansion device 22. In FIG. 8, a solid line 50 indicates the case where the difference ΔP (=P2−P1) is ΔP=4 MPa, and a solid line 51 indicates the case where ΔP=3 MPa. Furthermore, in FIG. 8, the specified value vth is the value of the refrigerant flow velocity at which pipe vibration does not occur.

In order that the following explanation be simplified, the explanation will be given with respect to the case where the Cv Value is the opening degree of the expansion device 22. As indicated in FIG. 8, when the Cv value, that is, the opening degree, increases, the refrigerant flow velocity v also increases. Therefore, in order that the refrigerant flow velocity v be kept less than or equal to the specified value vth, it is necessary to decrease the opening degree. More specifically, as indicated by the solid line 50 in FIG. 8, when ΔP=4 MPa, a Cv value corresponding to the specified value vth is Cv1. Thus, when ΔP=4 MPa, Cv1 is the second threshold. Therefore, the opening degree of the expansion device 22 is set in such a manner as to be less than Cv1. This setting prevents occurrence of pipe vibration. Similarly, as indicated by the solid line 51 in FIG. 8, when ΔP=3 MPa, a Cv value corresponding to the specified value vth is Cv2. Thus, when ΔP=3 MPa, Cv2 is the second threshold. Therefore, the opening degree of the expansion device 22 is set in such a manner as to be less than Cv2. This setting prevents occurrence of pipe vibration.

When the Cv value is not the opening degree of the expansion device 22, the controller 40 calculates, as the second threshold, an opening degree of the expansion device 22 that corresponds to Cv1. Similarly, the controller 40 calculates, as the second threshold, an opening degree of the expansion device 22 that corresponds to Cv2. The opening degree of the expansion device 22 is calculated from the Cv value according to any of the above methods. It suffices that a calculation formula or data table that defines such a relationship between the valve opening degree and the Cv value as indicated in FIG. 9 is prepared in advance, and the opening degree of the expansion device 22 is calculated from the Cv value using the calculation formula or the data table. Alternatively, it suffices that the opening degree of the expansion device 22 is calculated from the Cv value using the calculation formula on the right-hand side of the formula (3) indicated above.

Thus, the refrigerant flow velocity v at which the high-pressure refrigerant flows into the low-pressure pipe varies depending on the difference ΔP (=P2−P1) between the first detection value P1 of the low-pressure-side pressure sensor 502 and the second detection value P2 of the high-pressure-side pressure sensor 501. Therefore, the controller 40 determines in advance the specified value vth of the refrigerant flow velocity v at which pipe vibration does not occur, calculates a Cv value for the specified value vth of the refrigerant flow velocity v according to the difference ΔP, at which pipe vibration does not occur, and determines the opening degree of the expansion device 22 based on the Cv value.

As described above, in Embodiment 1, the air-conditioning apparatus 100 includes the refrigerant cycle circuit A in which heat-source-side refrigerant circulates and the heat-medium cycle circuit B in which a heat medium circulates, and the heat-medium heat exchanger 20 causes heat exchange to be performed between the heat-source-side refrigerant and the heat medium. Furthermore, the air-conditioning apparatus 100 includes the low-pressure-side pressure sensor 502 configured to detect the pressure of the heat-source-side refrigerant that flows into the refrigerant container 13 and output the pressure as the first detection value P1. In addition, the air-conditioning apparatus 100 includes the high-pressure-side pressure sensor 501 configured to detect the pressure of the heat-source-side refrigerant discharged from the compressor 10 and output the pressure as the second detection value P2.

In Embodiment 1, when switching the operation mode of the air-conditioning apparatus 100, the controller 40 determines, using the above formula (1), whether the ratio of the first detection value P1 to the second detection value P2 is higher than the first threshold. When the ratio of the first detection value P1 to the second detection value P2 is higher than the first threshold, the controller 40 controls the second refrigerant flow switching devices 24*a* and 24*b* to perform the switching operations thereof, since the difference between the first detection value P1 and the second detection value P2 is small. In such a manner, in Embodiment 1, the pressure of the heat-source-side refrigerant is detected, and when the pressure satisfies P1/P2>0.5, the switching operations of the second refrigerant flow switching devices 24*a* and 24*b* are performed. This prevents occurrence of pipe vibration.

Furthermore, in Embodiment 1, when the pressure of the heat-source-side refrigerant does not satisfy P1/P2>0.5, the controller 40 determines the second threshold for the opening degrees of expansion devices 22*a* and 22*b* to prevent the refrigerant flow velocity v from exceeding the specified value vth. The controller 40 determines the opening degrees of the expansion devices 22*a* and 22*b* such that the opening degrees of the expansion devices 22*a* and 22*b* are less than the second threshold. It should be noted that, as described above, the specified value vth is the flow velocity at which pipe vibration does not occur. Therefore, the controller 40 determines the opening degrees of the expansion devices 22*a* and 22*b* such that the opening degrees are less than the second threshold, as a result of which the refrigerant flow velocity v falls within the range of flow velocities at which pipe vibration does not occur. After adjusting the opening degrees of the expansion devices 22*a* and 22*b*, the controller 40 causes the second refrigerant flow switching devices 24*a* and 24*b* to perform the switching operations thereof. This prevents occurrence of pipe vibration.

Furthermore, as described above, the second threshold varies depending on the difference ΔP in pressure of the heat-source-side refrigerant between the second detection value P2 and the first detection value P1. Therefore, the controller 40 calculates the second threshold based on the difference ΔP in pressure. To be more specific, the second threshold varies depending on the difference ΔP in the above pressure and the refrigerant flow velocity v. Therefore, the controller 40 determines the second threshold based on the difference ΔP and the refrigerant flow velocity v, for example, using the right-hand side of the above formula (2). It is therefore possible to accurately determine the second threshold in accordance with the first detection value P1 and the second detection value P2 and control the opening degrees of the expansion devices 22*a* and 22*b* such that the opening degrees are set to appropriate values.

The invention claimed is:

1. An air-conditioning apparatus comprising:

a refrigerant cycle circuit in which a compressor, a first refrigerant flow switching device, a heat-source-side heat exchanger, a plurality of expansion devices, a plurality of heat-medium heat exchangers, and a plurality of second refrigerant flow switching devices are connected by a refrigerant pipe, the refrigerant cycle circuit being configured to cause heat-source-side refrigerant to circulate through the refrigerant pipe; and a heat-medium cycle circuit in which the heat-medium heat exchangers, a pump, and a plurality of load-side heat exchangers are connected by a heat medium pipe, the heat-medium cycle circuit being configured to cause a heat medium to circulate through the heat medium pipe, wherein each of the heat-medium heat exchangers is configured to cause heat exchange to be performed between the heat-source-side refrigerant and the heat medium, the air-conditioning apparatus further comprising:

a low-pressure-side pressure sensor configured to detect a pressure of the heat-source-side refrigerant that flows into the compressor and output the pressure as a first detection value;

a high-pressure-side pressure sensor configured to detect a pressure of the heat-source-side refrigerant discharged from the compressor and output the pressure as a second detection value; and a controller configured to control opening degrees of the expansion devices, the air-conditioning apparatus having a heating operation mode and a cooling operation mode as operation modes, wherein the first refrigerant flow switching device is configured to switch a flow of the heat-source-side refrigerant between the flow of the heat-source-side refrigerant in the heating operation mode and the flow of the heat-source-side refrigerant in the cooling operation mode, wherein each of the second refrigerant flow switching devices is configured to switch the flow of the heat-source-side refrigerant, according to switching of the operation mode of the air-conditioning apparatus, such that an associated one of the heat-medium heat exchangers operates as a condenser or an evaporator, wherein each of the expansion devices is provided in association with an associated one of the heat-medium heat exchangers and located upstream of the associated heat-medium heat exchanger in a flow direction of the heat-source-side refrigerant when the associated heat-medium heat exchanger operates as an evaporator, wherein each of the second refrigerant flow switching devices is provided in association with an associated one of the heat-medium heat exchangers and located downstream of the associated heat-medium heat exchanger in the flow direction of the heat-source-side refrigerant when the heat-medium heat exchanger operates as an evaporator, wherein the controller is configured to determine, when switching the operation mode of the air-conditioning apparatus, whether a ratio of the first detection value to the second detection value is higher than a first threshold or not, wherein the controller is configured to perform, when the ratio is higher than the first threshold, control to cause one of the second refrigerant flow switching devices to perform a switching operation, the one of the second refrigerant flow switching devices being required to perform the switching operation, according to switching of the operation mode of the air-conditioning apparatus, wherein the controller is configured to adjust, when the ratio is less than or equal to the first threshold, an opening degree of one of the expansion devices that is connected to the second refrigerant flow switching device required to perform the switching operation, such that the opening degree of the one of the expansion devices is less than a second threshold, and perform control to cause the second refrigerant flow switching device to perform the switching operation.

2. The air-conditioning apparatus of claim 1, wherein the heating operation mode includes a heating only operation mode in which all the load-side heat exchangers operate as condensers, and a heating main operation mode in which one or more of the load-side heat exchangers operate as condensers and an other or others of the load-side heat exchangers operate as evaporator, and the cooling operation mode includes a cooling only operation mode in which all the load-side heat exchangers operate as evaporators, and a cooling main operation mode in which one or more of the load-side heat exchangers operate as evaporators and an other or others of the load-side heat exchangers operate as condensers.

3. The air-conditioning apparatus of claim 1, wherein the controller is configured to calculate the second threshold based on a difference between the second detection value and the first detection value.

4. The air-conditioning apparatus of claim 1, wherein the controller is configured to:

determine, before determining whether the ratio is higher than the first threshold or not, whether the switching of the operation mode corresponds to switching of the operation mode that causes the heat-medium heat exchanger which operates as a condenser to start to operate as an evaporator, in a case where the switching of the operation mode is performed; and determine whether the ratio is higher than the first threshold or not, when the switching of the operation mode corresponds to the switching of the operation mode that causes the heat-medium heat exchanger which operates as a condenser to start to operate as an evaporator.

5. The air-conditioning apparatus of claim 4, wherein the controller is configured to determine that the switching of the operation mode corresponds to the switching of the operation mode that causes the heat-medium heat exchanger which operates as a condenser to start to operate as an evaporator, when the switching of the operation mode is performed and the switching of the operation mode corresponds to any of switching (a) to switching (e) as indicated below, switching (a) in which the operation mode is switched from the heating only operation mode to the cooling only operation mode, switching (b) in which the operation mode is switched from the heating only operation mode to the cooling main operation mode, switching (c) in which the operation mode is switched from the heating only operation mode to the heating main operation mode, switching (d) in which the operation mode is switched from the heating main operation mode to the cooling only operation mode, and switching (e) in which the operation mode is switched from the cooling main operation mode to the cooling only operation mode.

6. The air-conditioning apparatus of claim 4, wherein the controller is configured to calculate the second threshold based on a difference between the second detection value and the first detection value and a flow velocity of the heat-source-side refrigerant, and the flow velocity of the heat-source-side refrigerant is a flow velocity at which the heat-source-side refrigerant which stays between the second refrigerant flow switching device and the expansion device flows into part of the refrigerant pipe that is located downstream of a location where the heat-source-side refrigerant stays, when the switching of the operation mode causes the heat-medium heat exchanger which operates as a condenser to start to operate as an evaporator.

7. The air-conditioning apparatus of claim 1, wherein the heating only operation mode is an operation mode in which all the heat-medium heat exchangers operate as condensers, the cooling only operation mode is an operation mode in which all the heat-medium heat exchangers operate as evaporators, the heating main operation mode and the cooling main operation mode are operation modes in which one or more of the heat-medium heat exchangers operate as condensers and an other or others of the heat-medium heat exchangers operate as evaporators.

* * * * *